United States Patent [19]

Hill et al.

[11] 4,044,937

[45] Aug. 30, 1977

[54] MULTIPLE BALL ELEMENT WAFER BREAKING APPARATUS

[75] Inventors: Thomas Hill, Gainesville; Ambrose Kennedy, Manassas, both of Va.; Walter Grey Thomson, Endwell, N.Y.

[73] Assignee: International Business Machines Corporation, Armonk, N.Y.

[21] Appl. No.: 624,632

[22] Filed: Oct. 21, 1975

[51] Int. Cl.[2] ..... B26F 3/00

[52] U.S. Cl. ..... 225/97; 225/96.5

[58] Field of Search ..... 225/1, 2, 93, 94, 96.5, 225/97, 103, 104; 29/413

[56] References Cited

U.S. PATENT DOCUMENTS

| | | | |
|---|---|---|---|
| 3,040,489 | 6/1962 | Costa | 225/2 X |
| 3,493,155 | 2/1970 | Litant et al. | 225/2 |
| 3,562,057 | 2/1971 | McAlister et al. | 29/413 X |
| 3,687,345 | 8/1972 | Carlson et al. | 225/2 X |
| 3,917,139 | 11/1975 | Kabanov et al. | 225/96.5 |
| 3,918,150 | 11/1975 | Gantley | 29/413 X |

*Primary Examiner*—Frank T. Yost
*Attorney, Agent, or Firm*—John E. Hoel

[57] ABSTRACT

An apparatus is disclosed for breaking apart, pre-scribed chips in a semiconductor wafer. The apparatus comprises a plurality of ball elements having a diameter substantially smaller than the diameter of the wafer, mounted in a support beneath the contacting plane. Located above and in spaced coaxial relationship with the ball elements is a plurality of purging gas/vacuum ports. The pre-scribed semiconductor wafer is mounted on an elastic film by means of an adhesive coating thereon.

The wafer, so mounted, is attached to a sliding carriage disposed so as to permit the wafer to freely move within said contacting plane. When the wafer is disposed in said contacting plane, the support for said ball element is raised into contact with the wafer. The relatively small radius of curvature of the ball elements induces a relatively large bending moment and consequently breaks the chip in the wafer along the pre-scribed lines. Omni-directional motion of the carriage causes all portions of the wafer to be brought in to contact with the ball elements, thereby inducing total separation along all pre-scribed lines. The purging gas/vacuum ports located respectively above each ball element, serve to remove debris from the broken regions of the wafer.

5 Claims, 11 Drawing Figures

MULTIPLE BALL ELEMENT WAFER BREAKING APPARATUS

FIELD OF THE INVENTION

The invention disclosed generally relates to semiconductor processing apparatus and more particularly relates to an apparatus for breaking a pre-scribed semiconductor wafer into component chips.

BACKGROUND OF THE INVENTION

Semiconductor components are conventionally made from circular wafers of silicon having a thickness of approximately 0.015 inches and a diameter of from 2 to 3 inches. Each wafer of silicon is sliced from a bole of silicon which has been drawn from a melt of molten silicon in a crucible. The sliced wafers are polished and then areas of diffusion and layers of insulation and metallization are deposited on the surface thereof by photolithographic techniques, so as to form each of a plurality of chip components in a rectilinear array. The wafer, with the rectilinear array of rectangular chip components, is then passed through a dicing operation using a diamond saw. Conventionally, a diamond saw blade cuts a kerf having a depth which is some fraction of the total thickness of the wafer. The rectilinear array of kerfs define the plurality of respective components making up the wafer. The component chips on the prescored wafer, are ready to be separated from one another by a wafer breaking process.

Prior art wafer breaking apparatus include the use of a simple cylindrical roller which is rolled across the back of the wafer in a manual operation. Another prior art apparatus includes a single hemisphere having a diameter substantially the same as that of the wafer, which is juxtaposed with the wafer. The wafer is then forced over the hemisphere thereby imparting breaks along the prescored line of the wafer. Still another prior art apparatus for breaking the wafer involves enveloping the wafer between two flexible sheets and pressing the wafer against a single hemispherical contour having a diameter substantially the same as that of the wafer. All of the prior art apparatus and techniques employed to break wafers have disadvantages. A particularly outstanding disadvantage of the prior art is the failure to break away the peripheral selvage which must be manually removed by the operator in existing wafer breaking machines. Such intervention by the operator introduces a source of contamination to wafer surface, slows the operation of breaking pre-scored the wafer, and reduces the possibility of automating the wafer breaking process.

OBJECTIVE OF THE INVENTION

It is an object of the invention to break a pre-scored wafer into component chips, in an improved manner.

It is another object of the invention to break a prescored wafer into component chips in a more efficient manner than available in the prior art.

It is still a further object of the invention to break a pre-scored wafer into component chips, so as to automatically break away the peripheral selvage.

It is still another object of the invention to break a pre-scored wafer into component chips, in a manner that can be automated.

It is still another object of the invention to remove the debris from the kerf of a broken wafer, in an improved manner.

SUMMARY OF THE INVENTION

These and other objects, features and advantages of the invention are accomplished by the multiple ball element wafer breaking apparatus disclosed herein. The apparatus includes a support means, a plurality of ball elements mounted on the support beams, each of the elements having a diameter substantially smaller than the diameter of the pre-scribed wafer to be broken. The apparatus includes a sliding carriage means associated with the support means and a flexible piece of sheet attached to the carriage means and defining a contact plane. The wafer is mounted on the flexible sheet so as to be capable of motion in the contact plane over the support means. The ball elements contacting the flexible sheet do so as to deflect the flexible sheet out of the contact plane, thereby inducing a bending moment at the point in the wafer juxtaposed with the ball elements. The carriage means displaces the flexible sheet in the contact plane so as to break the wafer along the prescribed lines. The apparatus will break the semiconductor wafer along the pre-scribed lines quite efficiently, will break the peripheral selvage from the wafer, and is amendable to automation.

DESCRIPTION OF THE FIGURES

These and other objects, features and advantages of the invention will be described with reference to the following figures.

DISCUSSION OF PREFERRED EMBODIMENT

Figure 1:
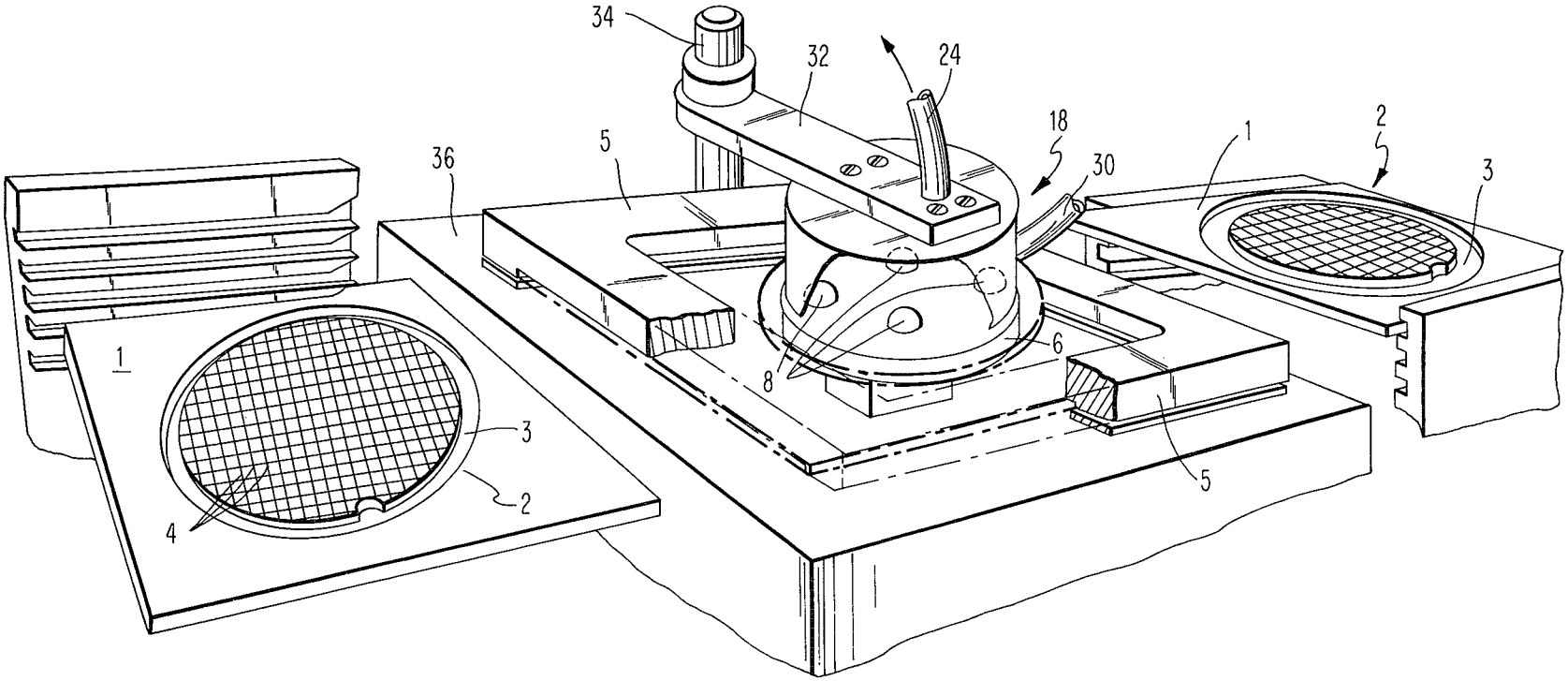
FIG. 1 illustrates an isometric view of the multiple ball element wafer breaking apparatus.
Figure 2:
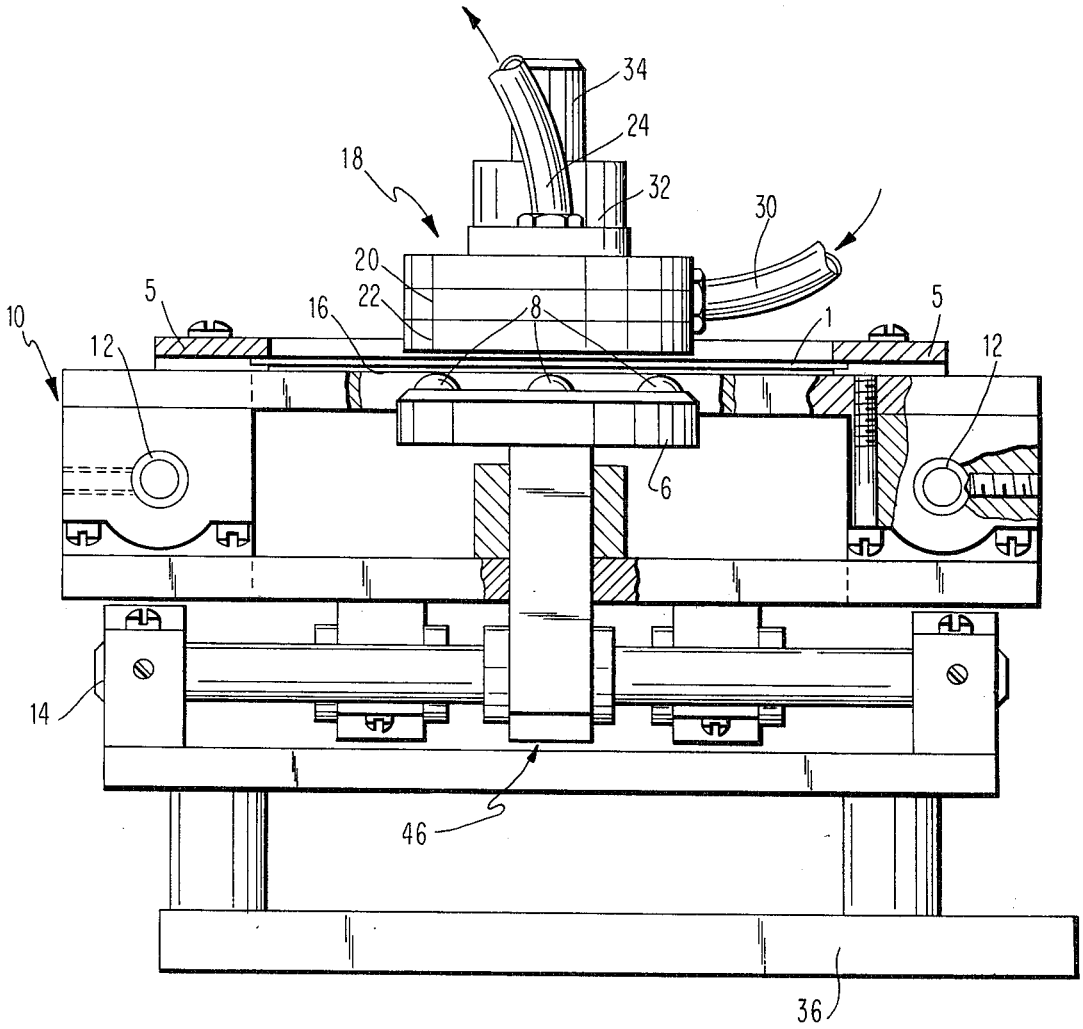
FIG. 2 is a front view of the apparatus.
Figure 3:
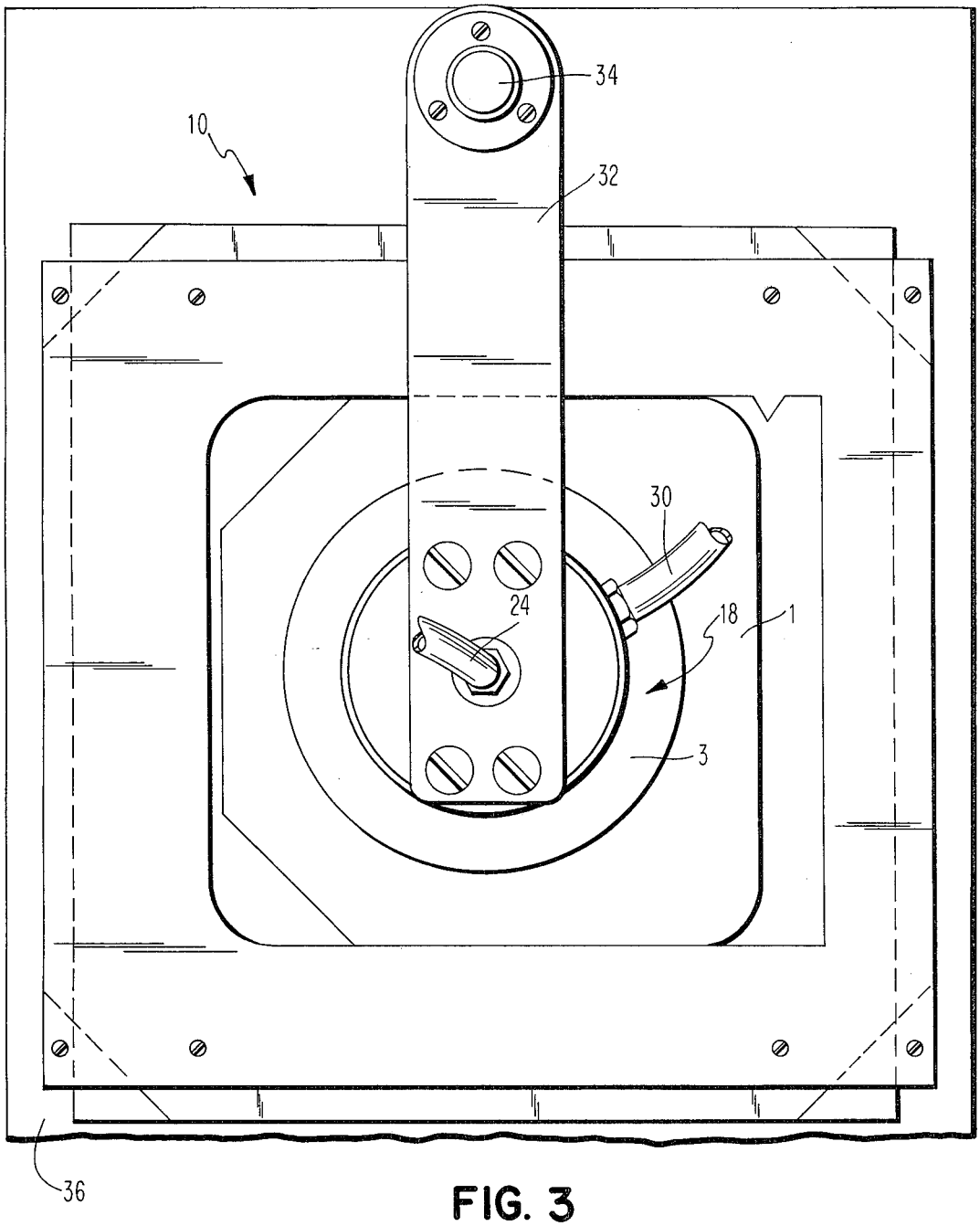
FIG. 3 is a top view of an orthogonal projection of the apparatus shown in FIG. 2.
Figure 4:
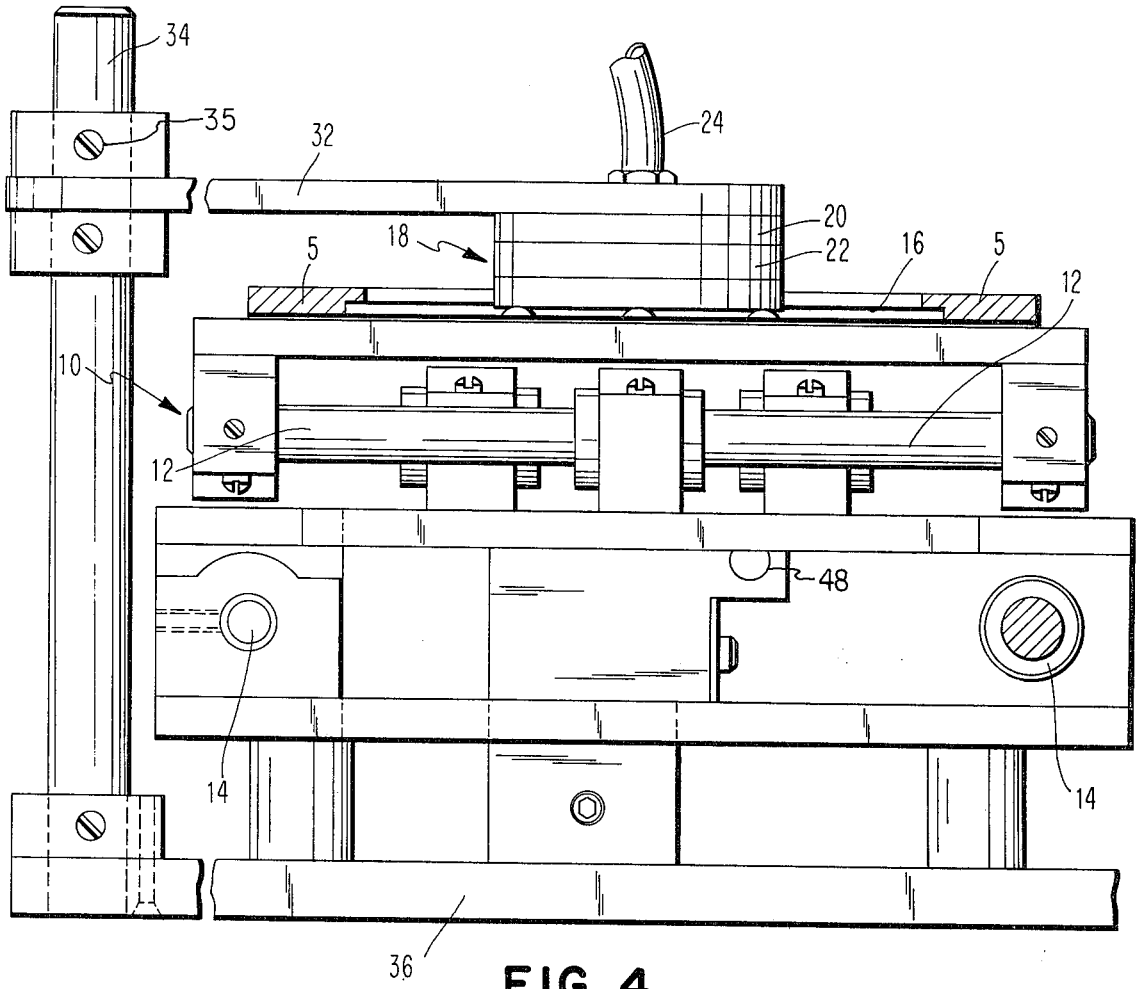
FIG. 4 is a left view of an orthogonal projection of the apparatus shown in FIG. 2.
Figure 5A:
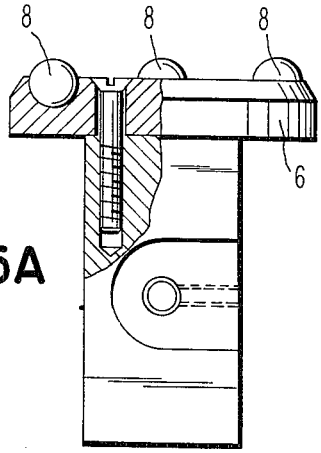
FIG. 5*a* is a front view of the ball element support means.
Figure 5B:
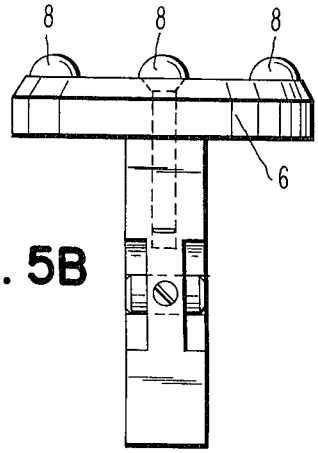
FIG. 5*b* is a left or orthogonal view of the support means shown in FIG. 5*a.*
Figure 6:
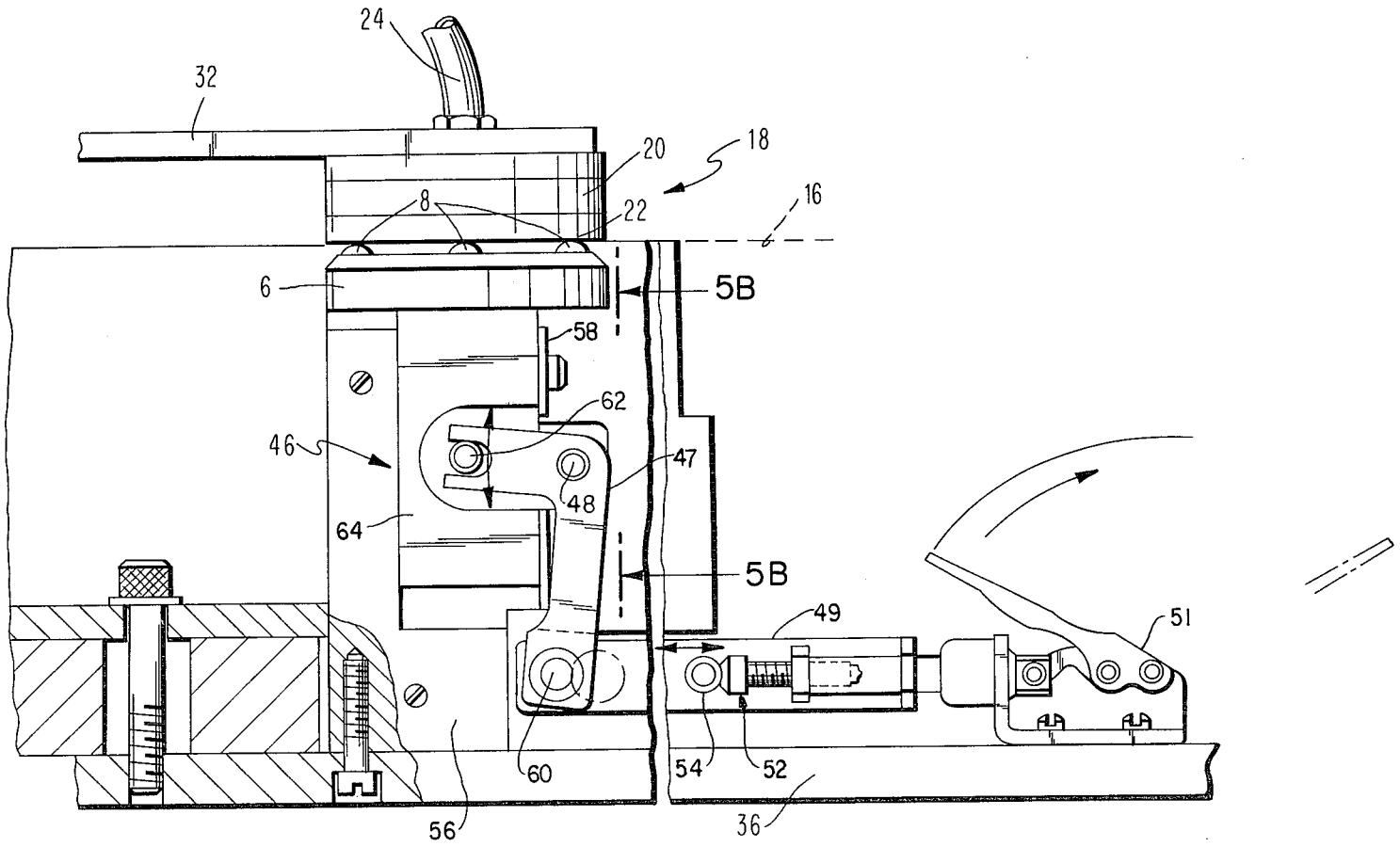
FIG. 6 is a side view of the lifting mechanism for the ball element support.
Figure 7A:
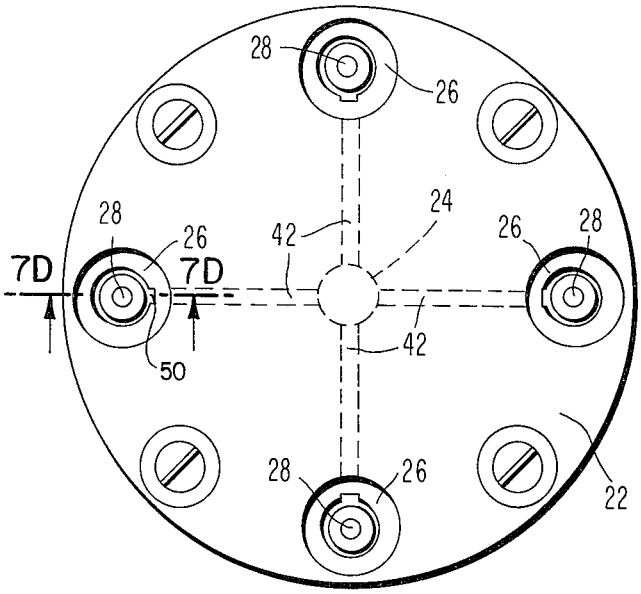
FIG. 7*a* is a view of the lower plate component of the debris removal housing showing the vacuum passages.
Figure 7C:
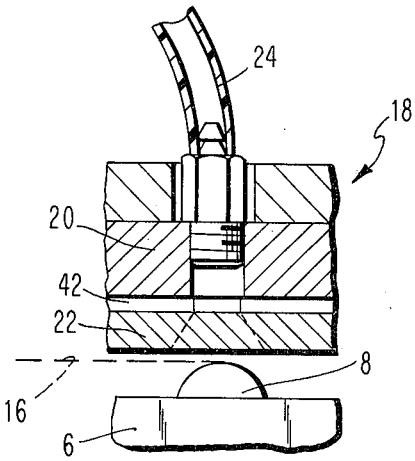
FIG. 7*c* is a cross sectional view along section AA' showing the vacuum ports.
Figure 7B:
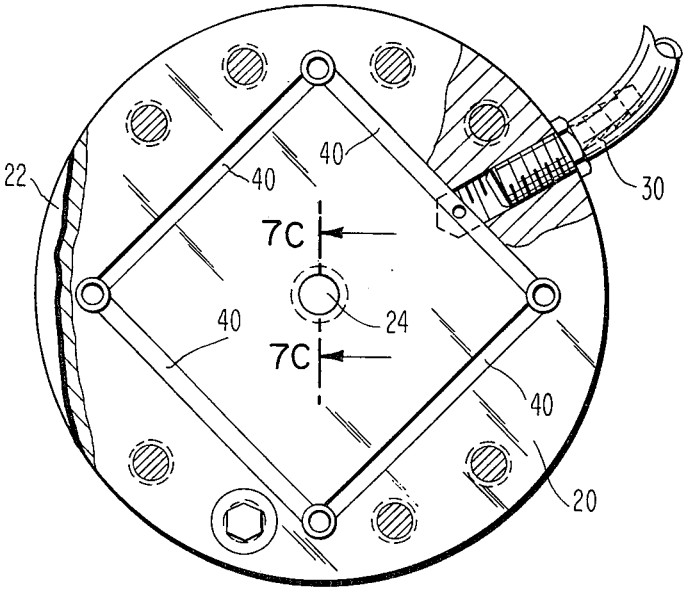
FIG. 7*b* is a view of the upper plate of the debris removal housing showing the positive pressure, purging gas passages.
Figure 7D:
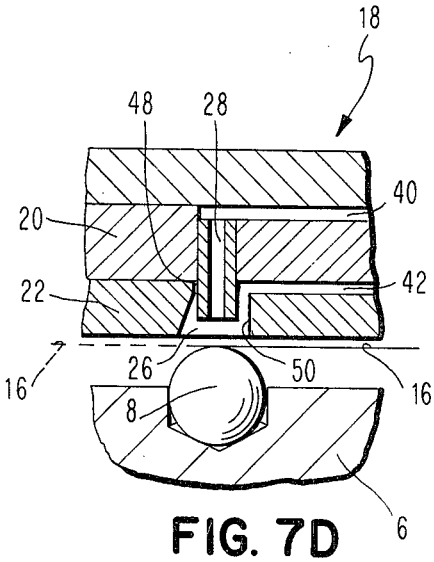
FIG. 7*d* is a cross sectional view along the lines D-D' showing a debris removing section of above the ball element.

The figures show the multiple ball element wafer breaking apparatus. The semiconductor wafer 2 is mounted on a flexible adhesive film 3 attached to the mounting card 1. The wafer has been pre-scribed along the lines 4 by a saw, in a rectilinear fashion. The wafer is positioned in the apparatus in the contact plane 16 by means of the guides 5. A support means 6 is positioned beneath contact plane 16 and supports a plurality of ball elements 8 mounted in the support means 6. The ball elements have a diameter substantially smaller than the diameter of the wafer 2. For example, for a two inch wafer diced into chips of approximately 0.15 × 0.15 inches, ball elements 8 have a diameter of 0.3125 inches. Balls 8 project above the upper surface of the support means 6 by 0.125 inches. The support means 6 is mounted on a lifting means 46 so as to undergo vertical motion displacing the top surface of the ball elements 8 through the contact plane 16. The lifting means 46 is mounted, in turn, on the base 36. Mounted also on the base 36 is the carriage means 10 having an X direction sliding mechanism 12 and a Y direction sliding mechanism 14. The guide members 5 are mounted on the sliding carriage mechanism 10. The card 1 bearing the semiconductor wafer 2, when mounted in the guides 5, can be horizontally displaced throughout the contact plane 16 by the combined motion of the X sliding means 12 and the Y sliding means 14. The movement of the wafer mounted on assembly 10 is provided manually. Slight hand pressure and motion is given to assembly 10 by the operator. The motion is restrained by the guide members 5 coming into contact with the housing means 18. The flexible adhesive sheet 3 attached to the card 1 occupies the contact plane 16. Suitable material for the flexible adhesive sheet 3 includes Scotch Low-Tac Tape, 3M682, a trademark of the Minnesota Mining and Manufacturing Company, Inc.

When the lifting means 46 is operated to lift the support means 6, the ball elements 8 are lifted so that their top-most surfaces engage the adhesive film 3 and the contact plane 16. Further lifting of the support means 6 by the lifting means 46 causes the ball elements 8 to contact the flexible sheet 3 to deflect the flexible sheet 3 out of the contact plane 16. The adhesive surface of the flexible sheet 3 causes the wafer 2 to remain attached to the sheet 3. The projection of the ball element 8 through the contact plane 16 thereby induces a bending moment about a point in the wafer 2 juxtaposed with the ball element 8. This bending moment causes a fracturing of the wafer along the kerf line 4 in the vicinity of the contact point for the ball elements with the wafer. The carriage means 10 is then displaced in arbitrary directions in the horizontal plane, thereby vertically displacing other portions of the flexible sheet 3 from the contact plane 16 so as to break the wafer 2 along all of the pre-scribed kerf lines 4.

The operation of the lifting means 46 is as follows. An overcenter locking toggle clamp handle 51 is moved manually counterclockwise from the rest position. This moves the yoke bracket 49 forward pushing pin 60 causing the bell crank 47 to pivot about the pivot 48 in a clockwise direction. The clevis of the bell crank 47 transfers this motion through pin 62 to a vertical movement of the mounting block 64 that supports the ball supporting means 6. The mounting block 64 is restrained to a vertical sliding motion by the guide block 56 and the bearing plates 58. The vertical position of the support means 6 is controlled by adjusting the interposer 52. The stroke of the toggle clamp 51 retaining the interposer 52 is fixed. The amount of this motion imparted to the bell crank 47 is controlled by adjusting the point in the stroke of the interposer 52 at which it contacts the crosspiece 54 in the yoke bracket 49.

A housing means 18 serves to remove the silicon wafer debris from the fracturing of the silicon wafer along the kerf lines 4. Housing means 18 comprised of a manifold 20, is disposed above contact plane 16 and is juxtaposed with a support means 6. The housing means 18 is supported by means of the support arm assembly 32 which is mounted, in turn, on the vertical shaft 34, fixed in the base plate 36. The support arm assembly 32 is positioned vertically and radially on the vertical shaft 34 by means of the set screw 35. A plurality of vacuum ports 26 are connected by means of the channels 42 and the plate member 22 to a vacuum nipple 24. The vacuum ports 26 and the housing means 18 are respectively disposed over the plurality of ball elements 8. In this manner debris produced from breaking wafer 2 in the region above the ball elements 8, can be removed. The slot 50 in the vacuum port 26 permits particles and debris from the wafer to be evacuated from the vicinity thereof.

The housing means 18 further contains the plurality of purging gas ports 28 which are connected by means of the channel 40 and the plate number 20 to the purging gas nipple 30. Each of this plurality of purging gas ports is respectively disposed within each of the plurality of vacuum ports 26, for directing a positive gas pressure of air or nitrogen gas, for example, at the point on the wafer surface to at which breakage is induced by the ball element 8. This serves to further assist in the removal of debris produced from the wafer fracturing operation.

Although 4 ball elements 8 have been shown in this preferred embodiment, a different number of ball elements may be selected for a particular application, depending upon the relative size of the semiconductor chips to be separated, the overall size of the wafer, the thickness of the wafer and the horizontal displacement through which the wafer can be moved in the breaking operation. Other ball element sizes can be employed so long as the balls are substantially smaller than the diameter of the wafer to be broken.

While the invention has been particularly shown and described with reference to the preferred embodiments thereof, it will be understood by those skilled in the art that the foregoing and other changes in form and details may be made therein without departing from the spirit and the scope of the invention.

We claim:

1. An apparatus for breaking a semiconductor wafer along pre-scribed lines, comprising;

a support means;

a plurality of ball elements mounted on said support means;

said ball elements having a diameter substantially smaller than the diameter of said wafer;

a sliding carriage means associated with said support means;

a flexible adhesive sheet attached to said carriage means defining a contact plane;

said wafer being mounted on said flexible sheet so as to be capable of motion in said contact plane over said support means;

said ball elements contacting said flexible sheet so as to deflect said flexible sheet out of said contact plane thereby inducing a bending moment about points in said wafer juxtaposed with said ball elements;

said carriage means displacing said flexible sheet in said contact plane so as to break said wafer along pre-scribed lines;

whereby the semiconductor wafer is broken along the pre-scribed lines in an improved manner.

2. The apparatus of claim 1 which further comprises:

a housing means disposed above said contact plane and juxtaposed with said support means;

a plurality of vacuum ports in said housing means respectively disposed over said plurality of ball elements;

whereby debris produced from breaking said wafer in a region above said ball elements can be removed.

3. The apparatus of claim 2, which further comprises;

a plurality of purging gas ports respectively disposed within each of said plurality of vacuum ports, for directing a positive gas pressure at said points in said wafer at which breakage is induced by said ball elements, to further assist in removal of debris produced therefrom.

4. The apparatus of claim 1 wherein said ball elements project from the top of said support means by approximately $\frac{1}{8}$ of an inch.

5. The apparatus of claim 1, wherein said plurality of ball elements comprises 4 ball elements.

* * * * *